US009914606B1

(12) United States Patent
Boucher et al.

(10) Patent No.: US 9,914,606 B1
(45) Date of Patent: Mar. 13, 2018

(54) MEDIA PATH JAM CLEARING

(71) Applicant: HEWLETT-PACKARD DEVELOPMENT COMPANY, L.P., Houston, TX (US)

(72) Inventors: Peter J Boucher, Vancouver, WA (US); Daniel Smith, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/293,631

(22) Filed: Oct. 14, 2016

(51) Int. Cl.
*B65H 29/34* (2006.01)
*B65H 5/36* (2006.01)
*B65H 1/26* (2006.01)

(52) U.S. Cl.
CPC ..... *B65H 5/36* (2013.01); *B65H 1/266* (2013.01); *B65H 2402/31* (2013.01); *B65H 2402/32* (2013.01); *B65H 2601/11* (2013.01)

(58) Field of Classification Search
CPC ..... B65H 2402/31; B65H 2402/32; B65H 1/266; A47B 88/48; A47B 88/49
See application file for complete search history.

(56) References Cited

U.S. PATENT DOCUMENTS 4,526,464 A 7/1985 Milillo
4,918,490 A 4/1990 Stemmle
5,030,991 A 7/1991 Zaitsu
5,226,714 A * 7/1993 Wright ..... A47B 88/48 312/323
6,757,506 B2 6/2004 Kahn
6,779,792 B2 8/2004 Lyga et al.
7,715,680 B2 * 5/2010 Krampotich ..... G02B 6/4455 385/134
7,871,075 B2 1/2011 Asaba
8,696,107 B2 4/2014 Lo et al.
2011/0187250 A1 * 8/2011 Larson ..... A47B 3/0912 312/322
2014/0319760 A1 * 10/2014 Komuro ..... B65H 31/20 271/223

OTHER PUBLICATIONS

Workgroup Color / Color MFP Paper Jam Resolution Procedures, Mar. 26, 2008, <http://my.okidata.com/idocs2.nsf/644f62e290bebe228525694d00496c00/049f7e9228ca79 >.

* cited by examiner

*Primary Examiner* — Howard J Sanders
(74) *Attorney, Agent, or Firm* — Tarolli, Sundheim, Covell & Tummino L.L.P.

(57) ABSTRACT

One example includes an apparatus comprising spaced apart rails, each of the rails including an opposing slot that extends longitudinally and parallel to each other and terminates at a stop located at an end of the rail. Support holders may attach to opposing sidewalls of a cassette body insertable between the rails. Elongated rods may link each rail and a corresponding one of the support holders. One end of each rod may fit in a respective slot to enable longitudinal movement of the rods relative to the rails, engagement between the one end of each rod and respective rail stop cooperating to enable rotation of the rods relative to the rails in a direction that is transverse to the longitudinal movement. Another end of each of the rods may be movably retained within a respective one of the support holders.

14 Claims, 8 Drawing Sheets

MEDIA PATH JAM CLEARING

BACKGROUND

Printer devices, such as printers, multifunction printers, copiers and the like, produce a representation of electronic data on a physical medium. Printer devices can print on variety of media types and sizes such as paper or transparency film. Printer devices include a variety of mechanisms, such as pickup mechanisms, rollers, shields, duplexers and platens to form a media path through the printer and to control the media as it moves through the media path. Occasionally, a sheet of media may become jammed as it moves through the media path. This can render the printer inoperative until the media jam is cleared.

DETAILED DESCRIPTION

Occasionally, a sheet of media may become jammed as it moves through the media path of a printer device. This may render the printer inoperative until the media jam is cleared. This disclosure relates to a media path jam clearing assembly and a method of its use. For example, the assembly enables a jam clearing cassette to be pulled out of the printer device and rotated out of the way to facilitate jam clearing. Since the assembly may further enable the cassette to remain attached to the printer device during jam clearing, the assembly further facilitates reinsertion of the cassette as well as mitigates losing or dropping the cassette.

As an example, the assembly includes a linking rod to attach a cassette body (e.g., a jam clearing cassette) to a housing of a printer device. For example, guide rails are attached on opposing interior walls of the housing and support holders are attached to sidewalls of the cassette body. The guide rail receives one end of the linking rod and the support holders receive another end of the linking rod, both permitting longitudinal movement of the linking rod. Outside surfaces of the support holders also run in guide rails longitudinally while the cassette body resides mostly within the housing. Further longitudinal movement of the cassette removes the support holders from the respective guide rails and the movement is controlled by the linking rods.

The linking rods thus slide in and out of the guide rails as well as slide in and out of the support holders. For example, when the cassette body is inserted all the way into the housing, the links are almost fully contained within the support holders. When fully extended, stops close the end of the guide rails to prevent the linking rods from being withdrawn completely from the guide rails. To facilitate longitudinal movement of the linking rods within the support holders, each linking rod may have a channel along a lateral interior facing surface to receiving a corresponding pin extending outwardly from cassette sidewall. In the fully extended position, the channel terminates in a closed end that engages the pin to retain the end of each linking rod within its respective support holder. Such engagement in the fully extended position further may provide a pivot mechanism to enable the cassette body to rotate down to a stable, out-of-the-way position. In some examples, an opening in a lower surface of the support holder provides a free path through which the linking rod may traverse during its downward rotation thereof via the pivot mechanism. The assembly, as disclosed herein, thus provides a resourceful approach to remove and reinstall a portion of the media path from within a printer chassis to facilitate jam clearing.

Figure 1:
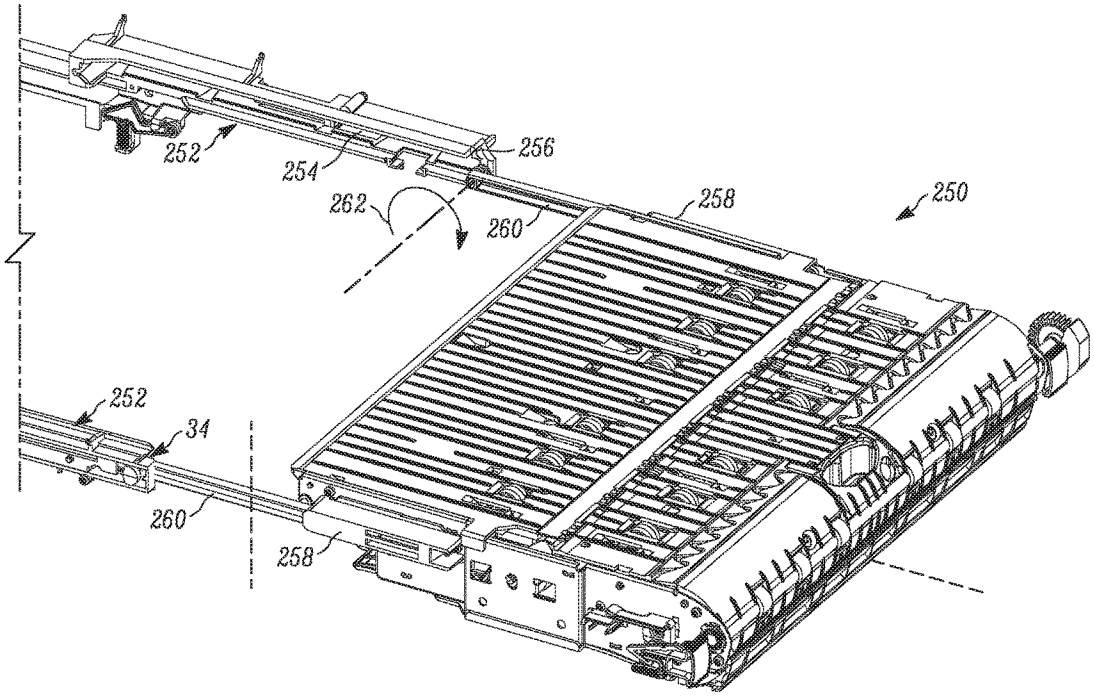
FIG. 1 depicts an example of an apparatus.

FIG. 1 depicts and example of an apparatus 250. The apparatus 250 includes spaced apart rails 252. Each of the rails 252 includes an opposing slot 254 that extends longitudinally and parallel to each other and terminates at a stop 256 located at an end of the rail. The apparatus 250 also includes support holders 258 to attach to opposing sidewalls of a cassette body insertable between the rails. The apparatus 250 also includes elongated rods 260 to link each rail and a corresponding one of the support holders. One end of each rod is to fit in a respective slot 254 to enable longitudinal movement of the rods relative to the rails. Engagement between the one end of each rod 260 and respective rail stop 256 cooperates to enable rotation of the rods 260 relative to the rails 252 in a direction 262 that is transverse to the longitudinal movement. An other end of each of the rods 260 is movably retained within a respective one of the support holders 258.

Figure 2:
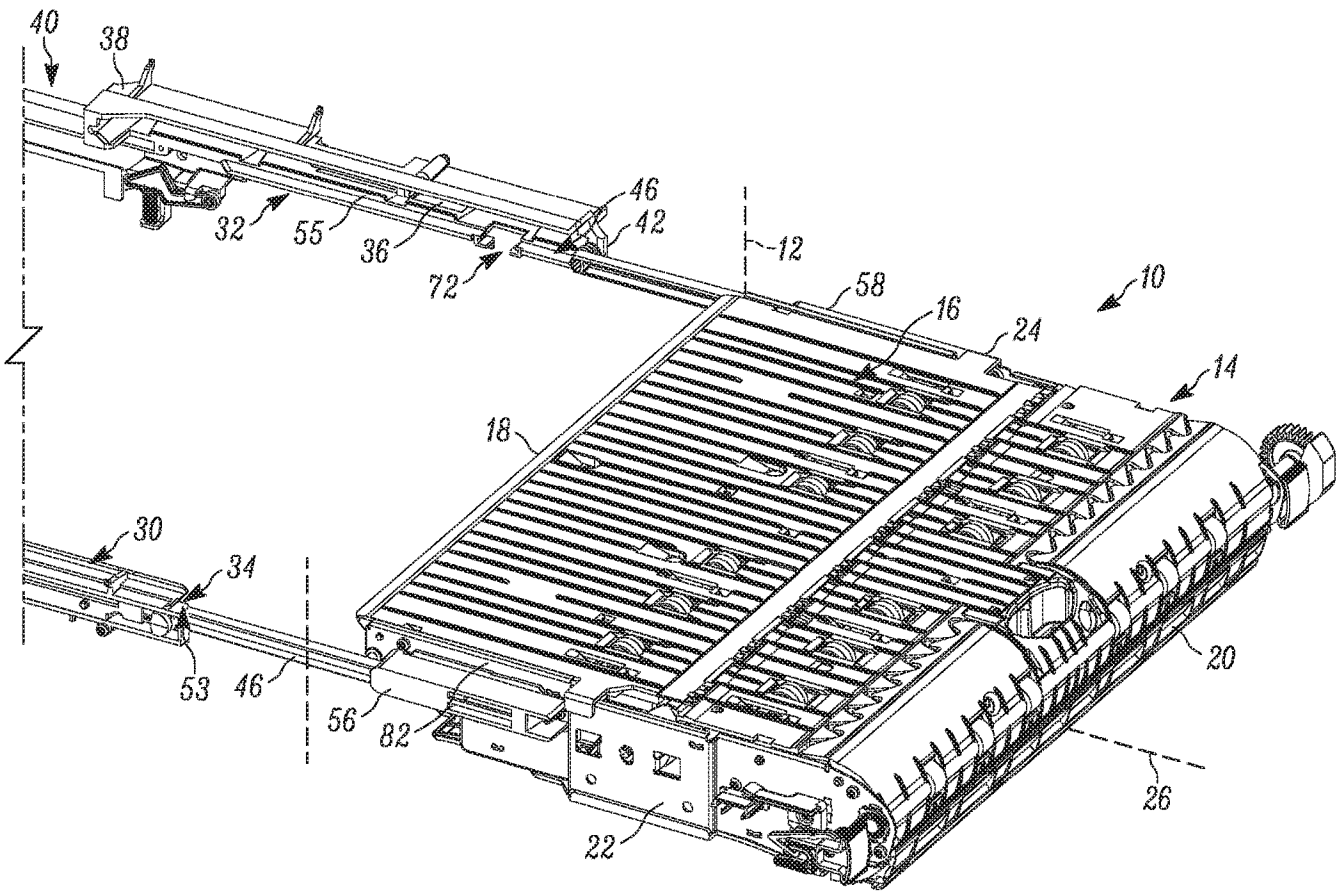
FIG. 2 depicts an example of a media path jam clearing assembly.

FIGS. 2-8 depict an example of jam clearing assembly 10, which can be implemented as part of a printer device 12. As used herein, for example, the printer device may be a printer such as a toner-based printer, inkjet printer, solid ink printer, thermal printer, impact printer, three-dimensional printer, and the like). The printer device 12 thus may be implemented as a single-function printing device, a multi-function peripheral device, a copier or the like that includes a media path that media traverses during printing. In the example of FIG. 2, the assembly 10 includes a cassette body 14 that may provide a portion of a media path 16 of the printer device 12 when the cassette body resides fully within the printer housing 12 in its storage position. For instance, the surface of the cassette body 14 can include a plurality of rollers or other structures to constitute the media path 16, which facilitate the propagation of media along the path.

In the example of FIG. 2, the cassette body 14 includes ends 18 and 20 that are spaced apart from each other by corresponding sidewalls 22 and 24. For example, the media may flow along the media path 16 in a longitudinal direction demonstrated by longitudinal axis 26 extending through the ends 18 and 20 of the cassette body. The assembly 10 facilitates jam clearing of a media path of the printer device by enabling the cassette body 14 to be moved in the longitudinal direction 26 between a storage position within the printer housing and a clearing position in which the cassette body 14 is withdrawn from the printer housing 12 as disclosed herein.

Figure 3:
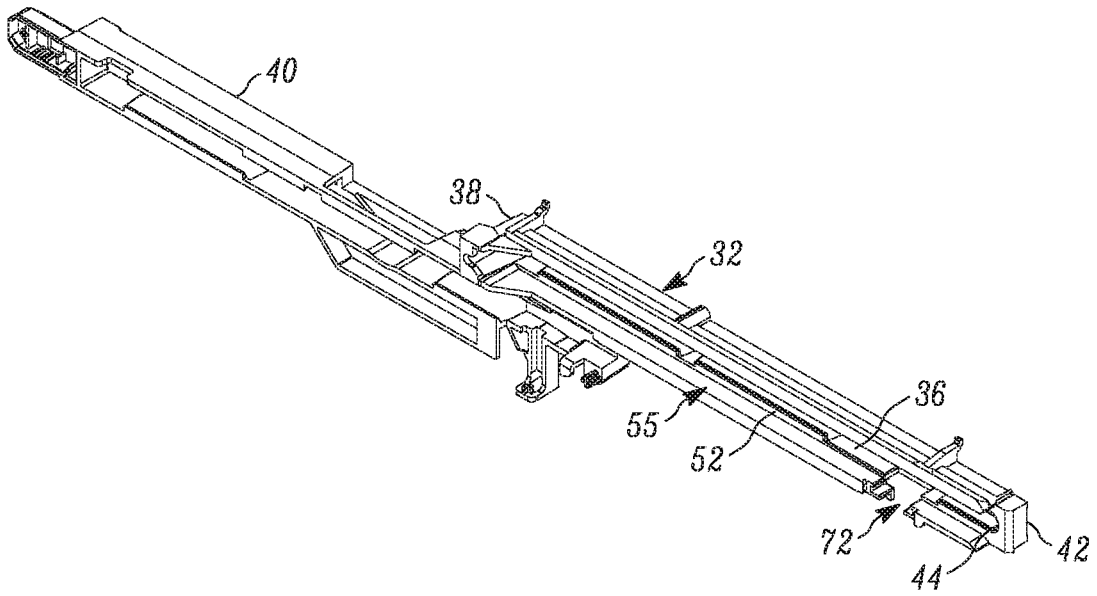
FIG. 3 depicts an example of a guide rail of the assembly of FIG. 2.

The assembly 10 includes a pair of guide rails 30 and 32 that are spaced apart from each other and attached to interior side walls of the printer housing 12. Each of the guide rails 30 and 32 includes one or more slots 34 and 36, respectively, to extend longitudinally and parallel to each other on opposing sides of the printer housing 12. As shown in FIG. 3, for example, the guide rail 32 extends longitudinally from a proximal end 38 at a base portion 40 (e.g., used for supporting other structures in the printer housing 12) to terminate in a distal end 42. The slot 36 thus can extend between the ends 38 and 42 and terminate at a corresponding stop 44 adjacent the distal end 42. The stop 44 can include a curved surface to facilitate rotation of an elongated linking rod 46, 48 such as disclosed herein. The guide rail can also include a lip 52 along an interior edge of each slot to help retain the corresponding knob of the linking rod therein as it travels longitudinally within the slot. The lip 52 may be disposed along upper and/or lower surfaces of the elongated slot 36 to retain each knob within its respective slot during movement of the rod 48 in the longitudinal direction.

As disclosed herein, each of the guide rails 30, 32 also includes an elongated channel 53, 55 that extends parallel with the respective slot 34, 36. The channels 53 and 55 provide a longitudinal path to receive respective support holders 56 and 58 that are attached to the sidewalls 22 and 24 of the cassette body 14 when the end 18 of the cassette body is at least partially within the housing 12 up to being fully inserted into the housing in the storage/normal-operating position. For example, the channels include parallel surfaces (e.g., top, bottom and side surfaces) to provide a substantially linear path for guiding the corresponding surfaces of the support holders 56 and 58. Mating exterior surfaces of the support holders 56 and 58 thus may run in the channels 53 and 53 of the respective guide rails 30 and 32 to help support of the cassette body 14 as it moves longitudinally within the housing 12. An open distal end of each channels 53 and 55 (adjacent the opening of the housing 12) may enable removal of the support holders 56 and 58 from within the housing 12, such as toward the extended position shown in FIG. 2. The open distal end of the channels 53 and 55 further may be chamfered to facilitate re-insertion of the support holders into the channels and thus insertion of the cassette body 14 into the printer housing 12.

As also shown in FIGS. 2-5, the assembly 10 includes a pair of the elongated linking rods 46 and 48 to couple each of the guide rails 30 and 32 to a corresponding support holder 56 and 58 that is attached to corresponding sidewall 22 and 24, respectively of the cassette body 14. By the constructions of the assembly 10, each of the ends of the linking rods 46 and 48 remain free to travel in a longitudinal direction from the storage position of the cassette body within the printer housing 12 to an extended position such as demonstrated in FIG. 2, while the opposed ends of the linking rods also remain connected with the guide rails and support holders. In the extended position, for example, the stop 44 of the guide rail 32 may prevent removal of the linking rod from the slot of the guide rail. Similarly, the other end of each rod 46, 48 is held within the support holders 56 and 58. In this way, the cassette body 14 can be extended out of the way to provide an opening into the printer housing 12 to facilitate jam clearing while remaining attached to the printer. Since the linking rods keep the cassette body attached to the printer device, a user does not have to place the cassette body on the ground or another location. This helps prevent the cassette body from being lost as well as prevents it from being dropped and potentially breaking.

By way of further illustration, FIGS. 3-8 depict examples of the linking rods 46 and 48, and their cooperation with the guide rails 30 and 32 and the support holders 56 and 58. In FIGS.-3-8, similar reference numerals, as introduced with respect to FIG. 2, are used to refer to similar parts throughout the various views. Additionally, for ease of explanation, guide rails, support holder and linking rods are demonstrated with respect to one side of the cassette body. The other side is constructed in a similar manner such as may be a mirror image of that shown. Thus, by implementing the components in such a manner at both sides of the housing 12 the cassette body can easily be removed and reinstalled, as disclosed herein.

Figure 4:
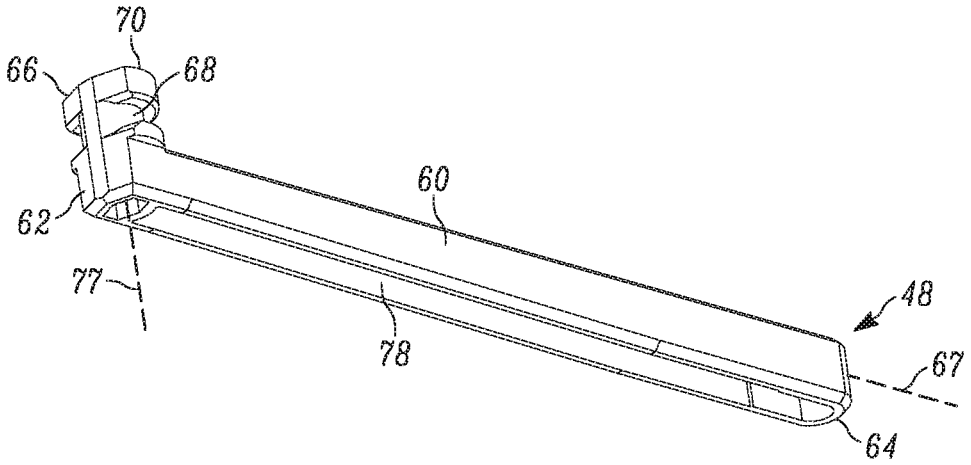
FIG. 4 depicts an example of a linking rod in the example of FIG. 2.

As demonstrated in the example of FIG. 4, the rod 48 includes an elongated body 60 that extends longitudinally between a proximal end 62 and a distal end 64. A knob 66 extends outwardly from the proximal end 62, such as transverse to a longitudinal axis 67 of the rod 48. For example, the knob 66 may have a T-shaped cross section including an intermediate portion 68 that extends from the rod body 60 at the proximal end 62 and terminates in a larger cross section portion 70. The larger cross section portion 70 at the end of the knob 66 can be configured to fit within the slot 36 of the guide rail 32. The retaining lip 52 thus can engage the outwardly extending shoulder defined by the enlarged cross-sectional portion 70 to retain the knob 66 within the slot 36 as it traverses within the slot.

Figure 5:
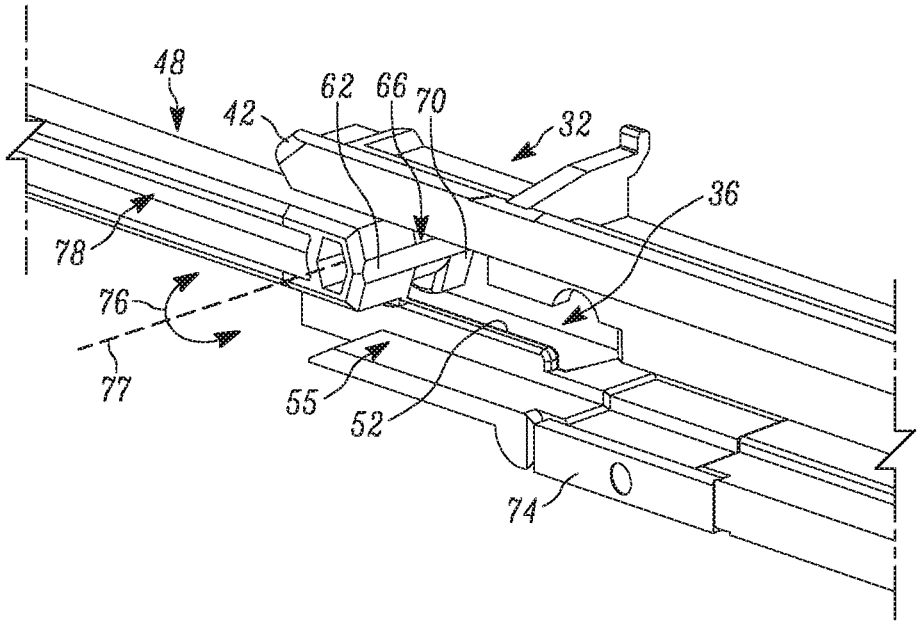
FIG. 5 is an example of guide rail and connecting rod attached therein in a full extension.

To facilitate insertion and removal (e.g., for service or repair of the printer device), the guide rail 32 may include a window opening 72 through which the proximal end 62 of the rod 48, including knobs 66 can be inserted and withdrawn with respect to the slot 36. As shown in FIG. 5, a cover 74 may be attached to close the opening 72 after the knob has been inserted into the slot. During longitudinal movement of the rod 48 with respect to the guide rail 32, the outwardly protruding portion 70 of the knob remains in the slot 36, while the lip 52 of the guide rail can fit into the intermediate portion 68 between the protruding portion 70 and the main body 60 of the linking rod 48. In this way, the knob 66 of the linking rod 48 fits into the slot 36 of the respective guide rail 32 to enable a sliding movement of the rod 48 relative to the guide rail 32. With the window opening 72 closed with its retaining structure, the rod 48 thus can slide into the longitudinal direction between the end 38 and the stop 44.

As a further example, the lateral surfaces of the intermediate extension 68 may be substantially parallel and spaced apart from each other a distance approximates (e.g., or less than) the distance between opposing lip portions 52 along the interior edge of the slot 36. Engagement between the lip portion 52 and opposing surfaces of the intermediate extension further may restrain rotation of the rod when the knob is spaced apart from the distal end within the housing. Stated differently, the lip portion 52 along the edge of the guide rail 32 can sandwich the extension portion 68 of the knob 66 to maintain a longitudinal position of the rod 48 that is parallel to the longitudinal extending guide rail 32 until rotation is permitted in a lip free region adjacent the stop 44.

As mentioned In the extended position, as shown in the example of FIG. 5, when the knob engages the stop 44 of the guide rail slot 36, the knob 66 cooperates with the guide rail stop 44 to enable rotation of the rod 48 transverse to the longitudinal direction such as in a direction shown at arrow 76 about an axis 77 extending through the knob transverse to the longitudinal axis 67 of the rod 48. For example, the knob 66 and curved stop 44 may constitute a pivot mechanism to enable rotation of the rod in the direction 76 with respect to the guide rail 32.

As also demonstrated in the examples of FIGS. 4 and 5, the linking rod 48 includes a longitudinal channel 78 formed in the sidewall of the body 60 between its ends 62 and 64. The channel 78 is to receive a rigid pin that extends outwardly from the sidewall of the cassette body 14. For example, a sheet of material, constituting a bracket 82, may be mounted to each sidewall 22 and 24 of the cassette body 14. The rigid pin 80 can be formed integral with or affixed to the bracket 82 and extend outwardly from the surface thereof (toward the walls of the housing 12 where the guide rails are attached). The rigid pin 80 can include a diameter designed to fit within the channel 78 of its respective rod.

Figure 6:
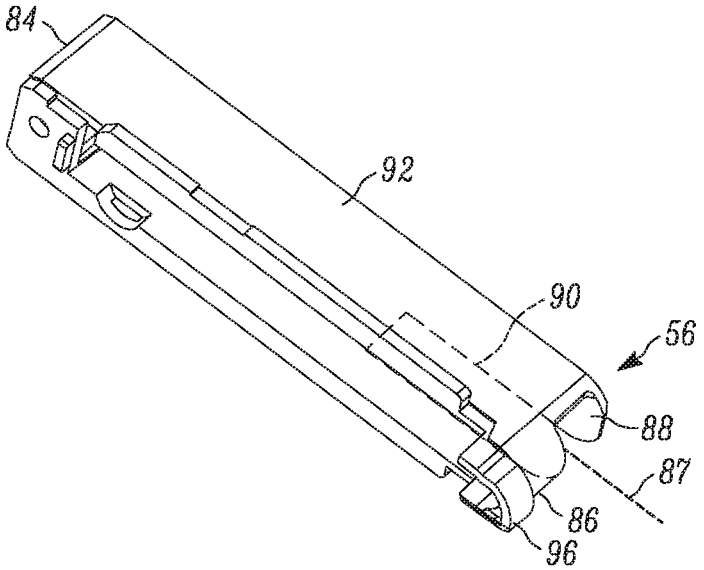
FIG. 6 depicts an example of a support holder in the example of FIG. 2.
Figure 7A:
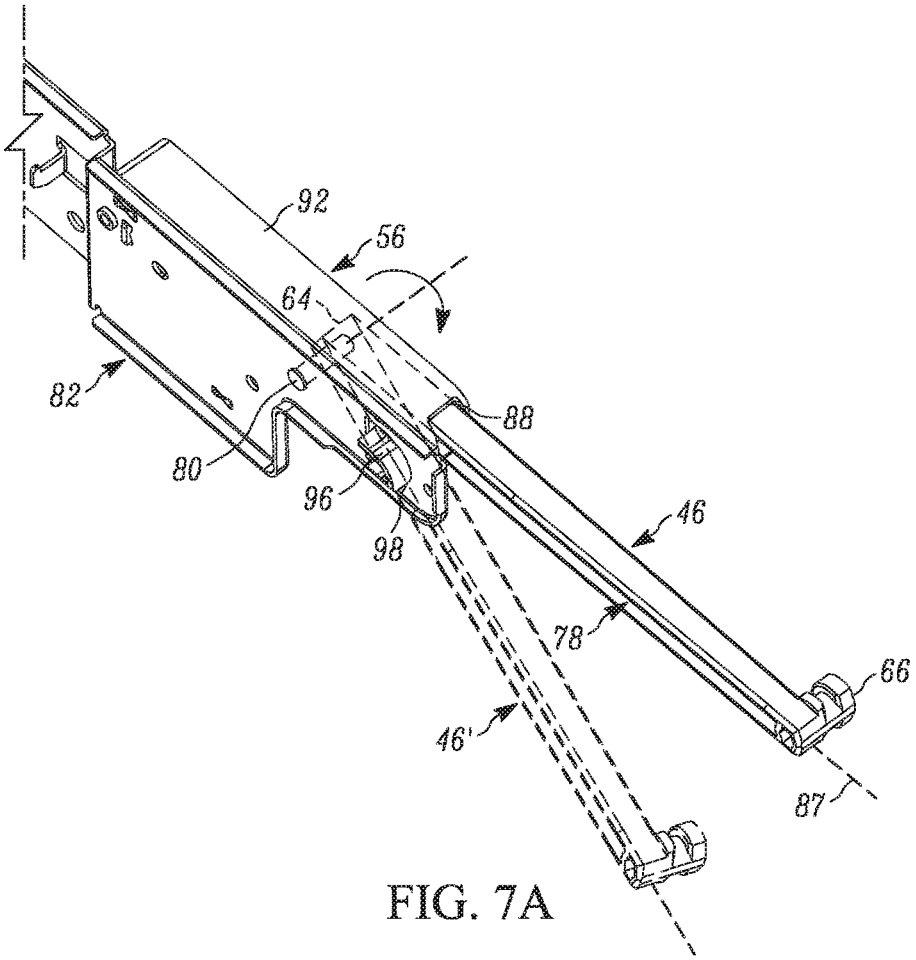
FIGS. 7A and 7B depicts an example of the linking rod mounted in the support holder of FIG. 6 in extended and storage positions.
Figure 7B:
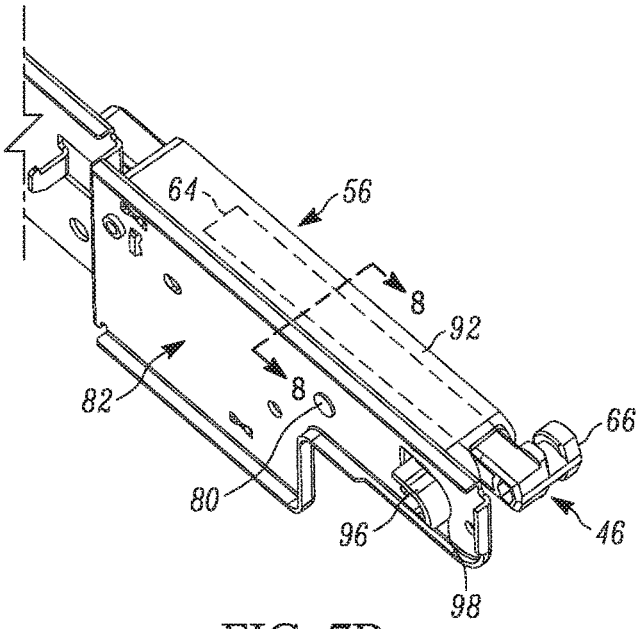

As further demonstrated in the examples of FIGS. 6, 7A and 7B, a distal end portion 64 of the elongated rod 46 is received within a respective support holder 56 constituting a case to enclose the distal end portion that is inserted therein. The support holder 56 thus provides an interior volume therein to receive the distal end portion of the rod 46 while the pin 80 extends into the channel 78 of the rod. In the examples of FIGS. 6 and 7A-B, the support holder 56 includes an elongated body that extends between ends 84 and 86. The proximal end 86 includes an opening 88 through which the body 60 of the rod 46 may freely traverse between extended position (FIG. 7A) and a stored position (FIG. 7B). The cooperation between the linking rods, support holders and guide rails provides a compact, telescoping design that takes up minimal space inside the printer.

As disclosed herein, the opening 88 may extend from the end 86 along a lower surface thereof to a location 90 that is spaced apart from such end adjacent a longitudinal position of the pin 80. In this way the opening 88 may provide an elongated slot from the end 88 that extends along the lower surface through which the body of linking rod 46 may traverse during rotation about the pin 80 while in its extended position, as demonstrated in dashed lines at 46'. An opposite wall (e.g., top wall) 92 from the slot can provide a retaining structure between the opening 88 at the end 86 and proximal end 84 to prevent rotation of the rods (and thus the cassette body) in the opposite direction. The wall 92 can be of rigid construction to help maintain the rod 46 in a longitudinal orientation substantially parallel with the long axis 87 of the support holder (e.g., due to engagement between the pin 80 and walls of the channel 78 and engagement of the rod body 60 and the interior surface of wall 92). The longitudinal, coaxial orientation between the rod 46 and the support holder 56 may be maintained by such construction until the rod has been withdrawn from the interior the support holder 56 to its extended (e.g., fully extended) position where the pin 80 engages an interior wall of the channel at proximal end 64.

As a further example, the pin 80 may have a curved surface (e.g., round body) and a diameter to fit into the channel 78. Engagement between the outer surface of the pin 80 and interior surface of the channel at proximal end 64 enables rotation of the rod 46 with respect to the support holder 56 and the cassette body to which the support holder has been attached via the bracket 82. In this way, cooperation between the pin 80 and the interior surface of the channel 78 constitute a pivot mechanism that enables rotation of the rod 46 in a direction that is transverse to the direction of longitudinal movement of the rod within the support holder 56 (e.g., rotation about an axis extending longitudinally through the pin 80). As disclosed herein, the other corresponding support holder 58 is similarly configured to receive the distal end portion of the other rod 48.

As shown in the extended position of FIG. 7A, a distal end portion of the linking rod 46 remains within the support holder 56 generally between the pin 80 and the opening 88. As a result, when the cassette body 14 is held by the user in the extended position, as retained by the pin 80, engagement between the wall 92 of the support holders 54 and 56 and the rods 46 and 48 helps to hold straight and aligned with respect to the cassette, such as shown in FIG. 2. This facilitates reinsertion of the cassette body 14 (e.g., one-handed reinsertion) into the housing 12 and also affords a sturdier, ergonomic feel. If the linking rods were allowed to pivot upward (e.g., through the wall 92), the additional degrees of freedom of cassette movement may adversely impact reinsertion of the cassette into the housing 12.

In some examples, such as demonstrated in FIGS. 6 and 7A-B, the support holder 56 may include a lateral extension 96 that extends from a corresponding surface edge transverse to the longitudinal axis 87. The lateral extension 96 may be configured to extend into a corresponding slot 98 of the bracket 82 such as shown in FIGS. 7A-7B. By fitting the extension 96 into the slot 98, the attachment of the support holder 56 to the bracket 82 and thus with respect to the side of the cassette body 14 is increased in strength.

Figure 8:
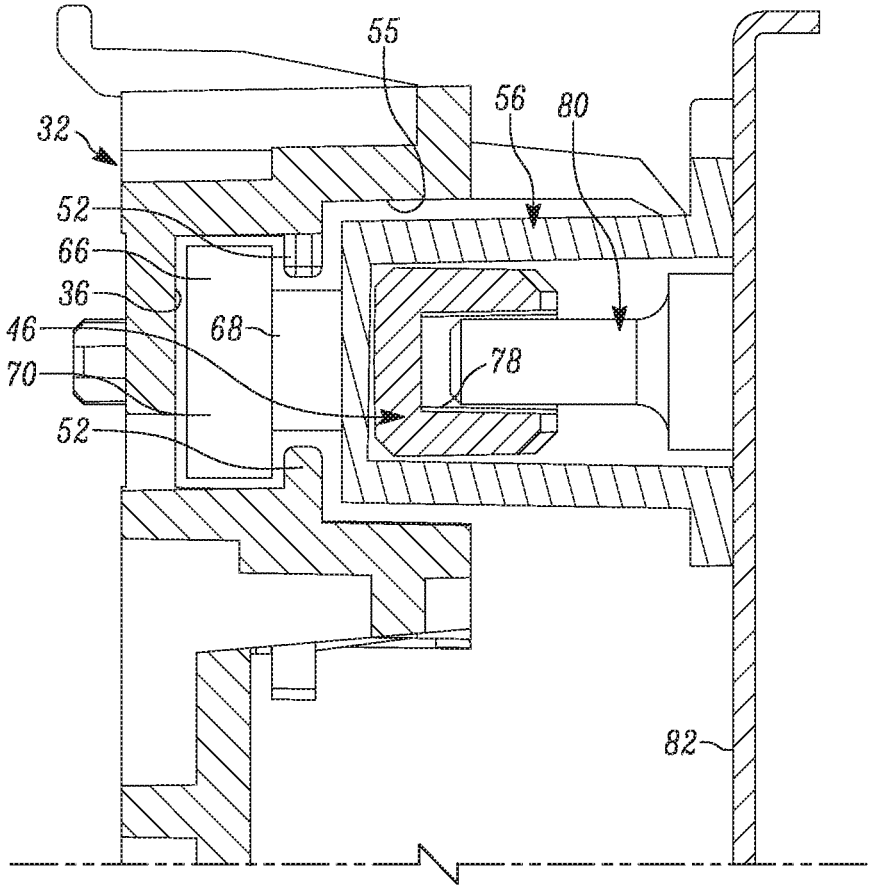
FIG. 8 is a partial cross-sectional view from the assembly of FIG. 2 demonstrating an example configuration for various components of the jam clearing assembly.

FIG. 8 is a partial cross-sectional view from the assembly of FIG. 7B taken along line 8-8. FIG. 8 thus demonstrates an example configuration for various interrelationships among components of the jam clearing assembly. As demonstrated in FIG. 8, the pin 80 extends into and is surrounded by the channel 78 of the linking rod 46, both of which reside within the support holder 56. The support holder 56 is received within the channel 55 of the guide rail 32. The end portion 70 of knob 66 further is shown within the slot 36, which runs parallel with the channel 55 of the guide rail 32, while the retaining lips 52 extend toward the intermediate extension 68 of the knob. From this storage position, the assembly may be urged to its extended position (e.g., out of the page), such as shown in FIGS. 2 and 7A.

Figure 9:
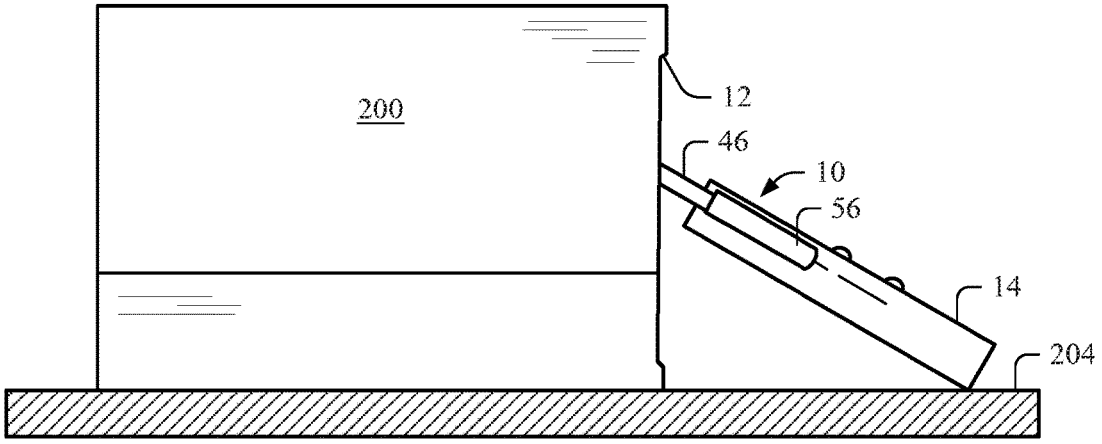
FIG. 9 depicts an example of a printer device with the jam clearing assembly in a first extended position outside of the printer housing.
Figure 10:
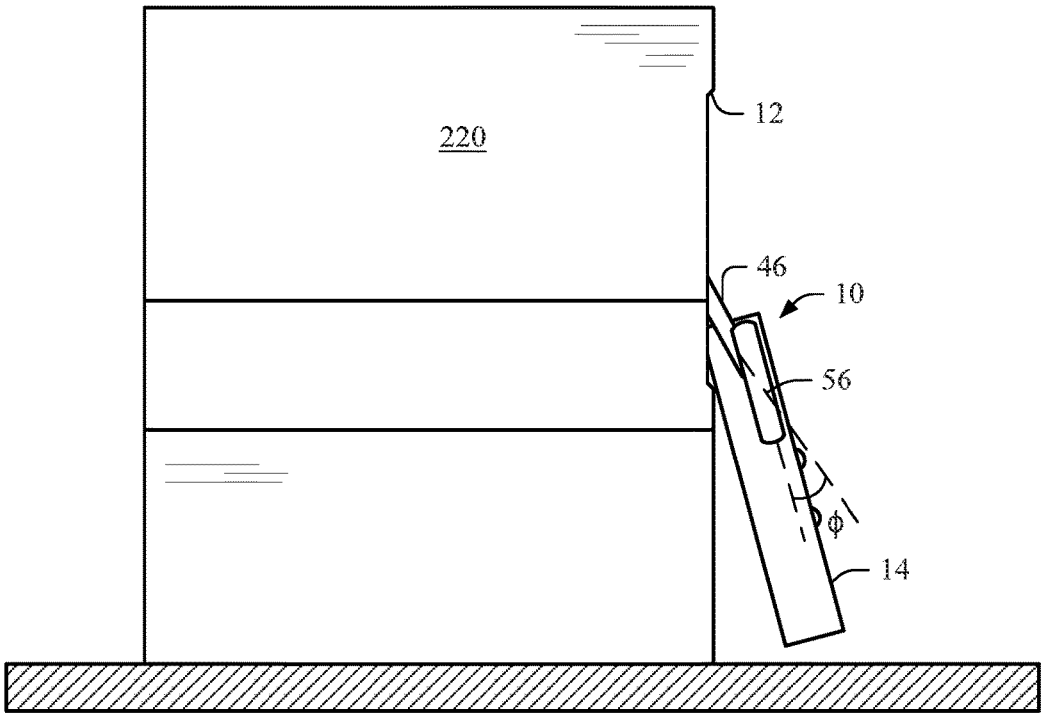
FIG. 10 depicts an example of another printer device illustrating the jam clearing assembly in another extended position outside of the printer housing.

FIGS. 9 and 10 depict examples of printer devices 200 and 220 that include jam clearing assemblies 10, such as disclosed herein. In each of the examples, a cassette body 14 is shown in an extended position outside the housing 12 of the printer device 200. In FIG. 9, the linking rod and the support holder 56 remain substantially parallel, such as extending coaxially as disclosed herein. This orientation is maintained in the extended position due to cooperation of the pin within the channel 78 and the rod engaging the wall 92 of the holder 56 as the end 20 of the cassette body engages a surface 204.

In the example of FIG. 10, the linking rods 46 and 48 has been rotated further with respect to the guide rails 30 and 32, such as due to the greater height of the printer device and, in particular, the distance between the surface 224 and where the cassette body is received within the printer housing 12. Additionally in FIG. 10, the linking rod 46 has been rotated with respect to the support holder 56 by an angle demonstrated at $\phi$. As disclosed herein, the angle of rotation $\phi$ is based on pivoting movement due to engagement between pins 80 and respective shoulders of the channel 78 of the linking rod 46 and 48. The opening 88 in the lower surface of the support holders permits such rotation of the rod through the opening in the direction as shown in FIG. 10.

The jam clearing assembly thus allows the cassette body 14 to be extended out of the way to provide ample user access to clear jams within the printer, yet remain attached to the printer via the linking rods' connection with the guide rails. Since the cassette body remains attached to the printer, a user doesn't have to find a place to put down the jam cassette. As a result, it can't get lost, it is easier to reinstall, and it cannot be dropped by the user. Additionally, when the cassette body 14 is extended, such as in FIG. 9 or 10, it rests in a stable position not likely to get damaged during the jam clearing process.

Figure 11:
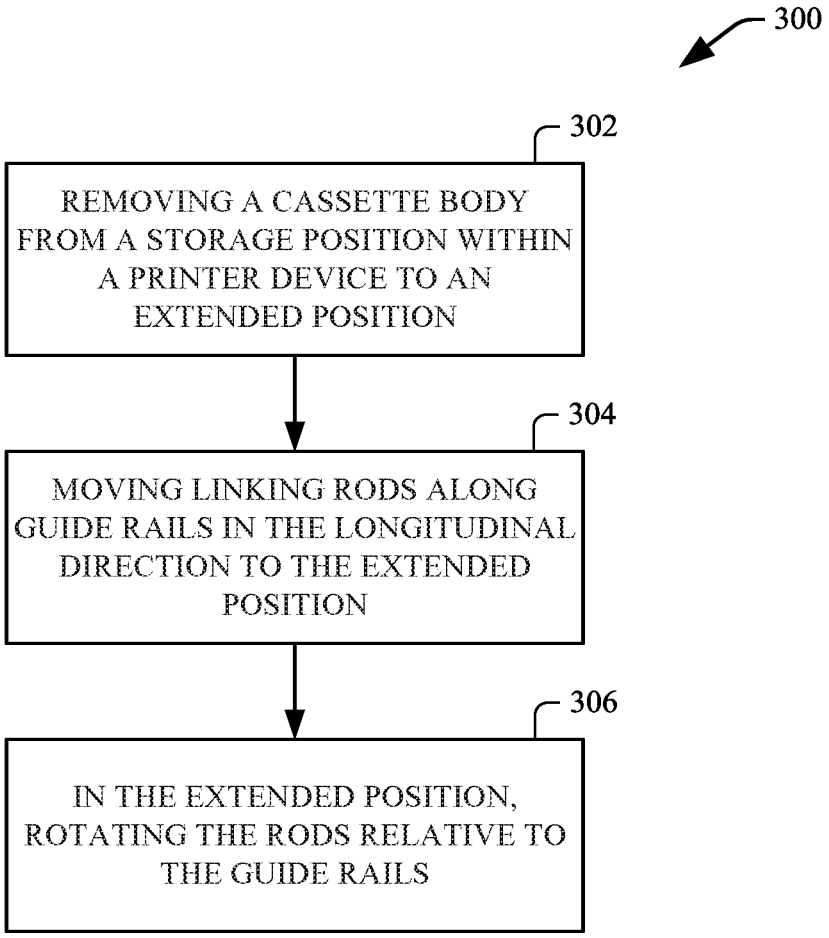
FIG. 11 is a flow diagram demonstrating an example of a method for removing a cassette body from a printer device.

In view of the foregoing structural and functional features described above, a method in accordance with various aspects of the present disclosure will be better appreciated with reference to FIG. 11. While, for purposes of simplicity of explanation, the method 300 of FIG. 11 is shown and described as executing serially, it is to be understood and appreciated that the present disclosure is not limited by the illustrated order, as some aspects may, in accordance with the present disclosure, occur in different orders and/or concurrently with other aspects from that shown and described herein. Moreover, not all illustrated features may be required to implement a method in accordance with an aspect of the present disclosure. The method 300 presumes starting with a cassette body (e.g., body 14) in a storage position for normal operation of the printer device.

In the example of FIG. 11, the method 300 begins at 302 by removing a cassette body (e.g, cassette body 14) in a longitudinal direction from a storage position within a housing of a printer device (e.g., housing 12) to an extended position for providing access to an interior of the printer device. The cassette body is coupled to the interior of the printer device by an assembly (e.g., assembly 10) that comprises linking rods (e.g., rods 46, 48) having ends connected to guide rails (e.g., guide rails 30, 32) mounted within the housing and other ends connected to respective support holders (e.g., support holders 56, 58) on opposing side edges of the cassette body.

At 304, removing the cassette further includes moving the linking rods along the guide rails in the longitudinal direction to the extended position thereof in which proximal ends of the linking rods engage a stop (e.g., stop 44) at a distal end of the guide rails to retain the proximal end within the guide rail and to enable rotation thereof. At 306, removing the cassette also includes in the extended position, rotating the linking rods relative to the guide rails in a direction transverse to the longitudinal direction, while retaining the other ends of the linking rods within respective support holders.

In other examples, in the extended position, methods can also include moving the other end of the linking rods in the longitudinal direction with respect to the support holders to the extended position in which pins extending outwardly from sidewalls of the cassette body engage an end of a longitudinal channel in a sidewall of the linking rods to enable rotation between the rods and the respective support holders. In the extended position, such method can also include rotating the rod with respect to the support holder and the cassette body in a direction that is transverse to the longitudinal direction. In such examples, the assembly thus can provide multiple joints (e.g., at each of the ends of the linking rods) to enable rotation at each such joint as to facilitate moving the cassette body to a position that affords easy access to the interior of the printer chassis. The assembly, which maintains the attachment between the cassette and the printer device, also facilitates reinsertion of the cassette back into the printer housing as disclosed herein.

What have been described above are examples. One of ordinary skill in the art will recognize that many further combinations and permutations are possible. Accordingly, this disclosure is intended to embrace all such alterations, modifications, and variations that fall within the scope of this application, including the appended claims. Additionally, where the disclosure or claims recite "a," "an," "a first," or "another" element, or the equivalent thereof, it should be interpreted to include one or more than one such element, neither requiring nor excluding two or more such elements. As used herein, the term "includes" means includes but not limited to, and the term "including" means including but not limited to. The term "based on" means based at least in part on.

What is claimed is:

1. An apparatus comprising:

spaced apart rails, each of the rails including an opposing slot that extends longitudinally and parallel to each other and terminates at a stop located at an end of the rail;

support holders to attach to opposing sidewalls of a cassette body insertable between the rails; and elongated rods to link each rail and a corresponding one of the support holders, one end of each rod to fit in a respective slot to enable longitudinal movement of the rods relative to the rails, engagement between the one end of each rod and respective rail stop cooperating to enable rotation of the rods relative to the rails in a direction that is transverse to the longitudinal movement, an other end of each of the rods being movably retained within a respective one of the support holders, wherein each one end of each rod further comprises an outwardly extending knob to fit within the slot of a respective one of the rails, each knob including a lip portion.

2. The apparatus of claim 1, wherein each rail comprises a window along a wall thereof to enable insertion and removal of the one end of the rod with respect to the slot.

3. The apparatus of claim 1, further comprising at least one pin extending outwardly from the sidewall of the cassette body within the support holder.

4. The apparatus of claim 3, each elongated rod further comprising a channel extending longitudinally along a side of the rod that is opposite the side from which the knob extends, the pin having a diameter to extend within the channel to provide for longitudinal movement of each rod within its corresponding support holder and wherein engagement between an end of the channel and the pin enables rotation of the rod with respect to the support holder in a direction that is transverse to the longitudinal movement thereof.

5. The apparatus of claim 3, wherein each support holder comprises an opening at an end thereof through which the respective rod extends.

6. The apparatus of claim 5, wherein the opening extends from the end thereof along a surface thereof to a longitudinal location adjacent the tab/pin to enable the rod to rotate about the pin/tab in the transverse direction beyond a height of the support holder.

7. A printer device comprising:

a housing that contains a media path;

a cassette body to provide a portion of the media path;

spaced apart guide rails attached to opposing interior sidewalls of the housing, each of the guide rails including a slot that extends longitudinally and parallel to each other within the housing and terminates at a stop located at an end of the guide rail adjacent an opening of the housing;

support holders attached to opposing side edges of the cassette body; and elongated rods to link each guide rail and a corresponding one of the support holders, one end of each rod including an outwardly extending knob to fit within the slot of a respective one of the guide rails to enable sliding movement of each respective rod relative to the guide rails in a longitudinal direction between the stop and an opposite end of the guide rail within the housing, each knob cooperating with its respective guide rail stop when the cassette body is extended to a position that is external to the housing to enable rotation of the rods relative to the guide rails in a direction transverse to the longitudinal direction, the other end of each of the rods being retained and moveable within a respective one of the support holders in the longitudinal direction along the side edge of the cassette body.

8. The device of claim 7, further comprising a rigid pin extending outwardly from each of the sidewalls of the cassette body within the support holder.

9. The device of claim 8, wherein each elongated rod includes a channel extending longitudinally in a side thereof opposing the side from which the knob extends, each pin having a diameter to fit within the channel of the respective rod to guide longitudinal movement of each rod within its corresponding support holder and wherein engagement between an end of the channel and the pin enables rotation of the rod with respect to the support holder and the cassette body in a direction that is transverse to the longitudinal movement thereof.

10. The device of claim 9, wherein each support holder comprises an opening at a distal end thereof through which the respective rod extends.

11. The apparatus of claim 10, wherein the opening extends from a proximal end of the support holder along a lower wall thereof to a location along the lower wall that is spaced apart from the distal end adjacent the pin to enable the rotation of the rod with respect to the support holder in the transverse direction through the opening.

12. The apparatus of claim 11, wherein the support holder includes an upper wall opposite the lower wall, the upper wall to prevent rotation of the rod about the pin in a direction that is opposite of its rotation in the transverse direction through the opening.

13. A method comprising:

removing a cassette body in a longitudinal direction from a storage position within a housing of a printer device to an extended position for providing access to an interior of the printer device, the cassette body being coupled to the interior of the printer device by an assembly that comprises linking rods having ends connected to guide rails mounted within the housing other ends connected to respective support holders on opposing side edges of the cassette body, wherein each of the guide rails includes an opposing slot that extends longitudinally and parallel to each other and terminates at a stop located at an end of the rail, wherein removing the cassette further comprises moving the linking rods along the guide rails in the longitudinal direction to the extended position thereof in which proximal ends of the linking rods engage a stop at a distal end of the guide rails to retain the proximal end within the guide rail and to enable rotation thereof; and in the extended position, rotating the linking rods relative to the guide rails in a direction transverse to the longitudinal direction, while retaining the other ends of the linking rods within respective support holders, wherein each one end of each rod further comprises an outwardly extending knob to fit within the slot of a respective one of the rails, each knob including a lip portion.

14. The method of claim 13, further comprising:

moving the other end of the linking rods in the longitudinal direction with respect to the support holders to the extended position in which pins extending outwardly from sidewalls of the cassette body engage an end of a longitudinal channel in a sidewall of the linking rods to enable rotation between the rods and the respective support holders; and in the extended position, rotating the rod with respect to the support holder and the cassette body in a direction that is transverse to the longitudinal direction.

* * * * *